US005969605A

United States Patent [19]

McIntyre et al.

[11] Patent Number: 5,969,605

[45] Date of Patent: Oct. 19, 1999

[54] CRIMPED CAN CALIPER

[75] Inventors: Norman J. McIntyre, Komoka; Joseph G. Vandewiel, Dorchester; Francis A. Vanderweyst, Mount Brydges, all of Canada

[73] Assignee: Labatt Brewing Company Limited, London, Canada

[21] Appl. No.: 09/069,798

[22] Filed: Apr. 30, 1998

[51] Int. Cl.[6] ..... G08B 23/00

[52] U.S. Cl. ..... 340/517; 340/605; 209/549; 209/597

[58] Field of Search ..... 340/674, 675, 340/676, 603, 605, 517; 209/529, 530, 531, 597, 604, 549

[56] References Cited

U.S. PATENT DOCUMENTS

| | | | |
|---|---|---|---|
| 3,879,993 | 4/1975 | Sorbie | 209/530 |
| 4,084,686 | 4/1978 | Calhoun | 198/468 |
| 4,092,949 | 6/1978 | Balordi | 118/670 |
| 4,121,103 | 10/1978 | Calhoun | 250/343 |
| 4,305,816 | 12/1981 | Flood et al. | 209/549 |
| 4,391,372 | 7/1983 | Calhoun | 209/523 |
| 4,593,369 | 6/1986 | Thompson | 364/552 |
| 4,608,843 | 9/1986 | Grims | 72/4 |
| 4,703,859 | 11/1987 | Pynsky | 209/597 |
| 4,899,791 | 2/1990 | Totten | 141/288 |
| 4,932,823 | 6/1990 | Castor et al. | 413/66 |
| 4,956,990 | 9/1990 | Williams | 72/349 |
| 4,976,131 | 12/1990 | Grims et al. | 72/347 |
| 5,016,463 | 5/1991 | Johansson et al. | 72/354.8 |
| 5,027,580 | 7/1991 | Hymes et al. | 53/366 |
| 5,054,341 | 10/1991 | Johansson et al. | 82/47 |
| 5,103,005 | 4/1992 | Gyure et al. | 544/251 |
| 5,119,311 | 6/1992 | Gold et al. | 364/476 |
| 5,142,769 | 9/1992 | Gold et al. | 29/621.1 |

OTHER PUBLICATIONS

Industrial Dynamics Company, Ltd., Filtec, FT–50 Fill Level Inspector, Can Version, High–Res Encoder, Centerline Trigger, ProLine Rejector, Installation and Operation Manual, Form 2352, 141 pages.

Continental Beverage Packaging, Division of Continental Can Company, Inc., "Modern Beverage Can Double Seaming", 32 pages.

*Primary Examiner*—Jeffery A. Hofsass
*Assistant Examiner*—Van T. Trieu
*Attorney, Agent, or Firm*—Levy & Grandinetti

[57] ABSTRACT

A method and apparatus is provided for detecting defective seams in cans having metal lids. The apparatus is mounted in cooperation with a conveyor to evaluate the cans being conveyed in a continuous operation. The apparatus includes a detecting device which has a pair of electrical contacts positioned to cooperate with a seam on the can. The electrical contacts are spaced apart a distance to contact a bulge in the seam which completes an electrical circuit between the contacts. A signal is then produced indicating a defective can, and the defective can is removed from the conveyor.

13 Claims, 5 Drawing Sheets

CRIMPED CAN CALIPER

BACKGROUND OF THE INVENTION

1. Field of the Invention

The present invention is directed to a method and apparatus for detecting defective containers on a conveyor. More particularly, the invention relates to a method and apparatus for detecting bulges in crimped seams of metal cans.

2. Description of the Background Art

Metal cans and particularly aluminum cans are commonly used in the beverage industry. The use of aluminum cans is advantageous since the manufacture of cans is less expensive than other containers, and the cans are easily handled by automated equipment.

A disadvantage of using cans for beverages is the tendency of the seams between the lid and the sidewall to form improperly. Various defects in the seam can be very difficult to detect during the manufacturing and packaging operations. Moreover, slight defects in the seam can result in leakage of the contents long after the cans are shipped to the customer. Such latent leaks in the cans often result in significant losses and additional expenses for the manufacturer, since the manufacturer is typically responsible for replacing defective merchandise.

Several devices have been used to maintain quality control in the manufacture and filling of beverage cans. An example of one such device projects a low-intensity, gamma-radiation beam through the sidewall of the can to ensure that the can is filled to the proper level. A sensor is positioned on the opposite side of the can to measure the intensity of the beam passing through the can. Under normal conditions, the beam passes through the sidewall and through the contents of the can to provide a certain intensity detected by the sensor. When the contents are below the level of the beam, the sensor detects a different beam intensity which indicates an improperly filled can. Although an improperly filled can often is indicative of a defective seam, cans with latent leaks are not detectable.

Accordingly, there is a continuing need in the industry for a device that is capable of detecting defective seams in a continuous manufacturing assembly.

SUMMARY OF THE INVENTION

The present invention is directed to a method and apparatus for inspecting the seams in a can filling and seaming operation. The invention is particularly directed to a method and apparatus for detecting defects in the seam formed between a can body and a lid and removing the respective defective can from the remaining cans having properly formed seams.

Accordingly, a primary object of the invention is to provide a method and apparatus for detecting defects produced by a seam-forming operation. The apparatus is particularly suitable for detecting seam defects caused by wrinkles, folds, or improperly compressed layers of metal formed during the seam-forming steps.

Another object of the invention is to provide a method and apparatus which can be readily incorporated into an existing can filling and seam-forming assembly to detect defective seams and discard the respective can.

The various aspects of the invention are basically attained by providing an apparatus for detecting defective seams between a container such as a can and its metal lid where the apparatus includes a conveyor and a detecting device. The conveyor includes a generally horizontal surface for continuously conveying a plurality of containers in a continuous canning operation and having a receiving end and a discharge end. The detecting device is positioned at a predetermined location along an operating length of the conveyor to receive the containers being conveyed.

The detecting device includes first and second electrical contacts positioned on opposite sides of the conveyor. The electrical contacts include an outwardly extending arm positioned at a location above the conveyor proximate the position of the can seams as the cans are being conveyed past the detecting device. The ends of the electrical contacts are spaced apart a distance slightly greater than the width of a properly formed seam whereby a container with a properly formed seam can pass between the electrical contacts without contacting or touching each of the electrical contacts simultaneously. The electrical contacts are preferably spaced sufficiently close together whereby a defect in a seam causing a bulge in the seam contacts both electrical contacts simultaneously. A seam having a bulged area caused by an improperly formed or defective seam has a diameter slightly greater than a properly formed seam, such that the can is not able to pass between the electrical contacts without touching both of the electrical contacts. An electrical power source is coupled to the electrical contacts and to an indicator device. When a defective seam contacts both of the electrical contacts simultaneously, the electrical circuit is completed, and the indicator device produces a signal indicating a defective can.

In desirable embodiments of the invention, an ejector device is provided downstream of the detecting device to eject containers having defective seams from the conveyor. A microprocessor is preferably connected to the detecting device and to the ejector device to actuate the ejector device at a suitable timing sequence to eject only defectively seamed containers from the conveyor without stopping the conveyor and without disrupting the advance of the containers.

These and other objects, advantages, and salient features of the invention will become apparent to one skilled in the art from the annexed drawings and the detailed description of the invention.

DETAILED DESCRIPTION OF THE INVENTION

The present invention is directed to a method and apparatus for identifying defective containers in a filling and sealing system. More particularly, the invention relates to a method and apparatus for identifying and detecting defective seams formed between a container and its associated lid.

The containers, in accordance with embodiments of the invention, can be any suitable container as known in the art. In preferred embodiments, the containers are cylindrical containers formed from metal, cardboard, or plastic. Containers, such as metal cans, typically have a lid that is attached to the cylindrical sidewall by a crimping operation. A particularly common form of container in the beverage industry is the seamless or deep-drawn can formed of aluminum. The can is initially formed with a closed bottom and an open top end. The can is passed through a filling station, and a lid is attached to the open top end of the can by crimping the edges of the lid and can together to form a continuous seam between the sidewall of the can and the lid. A preferred seam-forming process in the beverage industry produces what is referred to as a double seam. The present invention is primarily directed to a method and apparatus for detecting defective seams and identifying defective containers having a defective seam between the sidewall and the lid.

FIGS. 1 through 6 are illustrative of a typical seam-forming apparatus for producing a double seam to connect a lid to a metal can. The illustrated apparatus is intended to be exemplary of a suitable seam-forming apparatus. It will be recognized by those skilled in the art that various other seam-forming devices can be used for connecting a lid to a metal can. The invention is described herein as being primarily directed to metal cans formed with a double seam. The method and apparatus as discussed hereinafter in greater detail is suitable for use with cans having a metal or electrically conductive lid.

Figure 1:
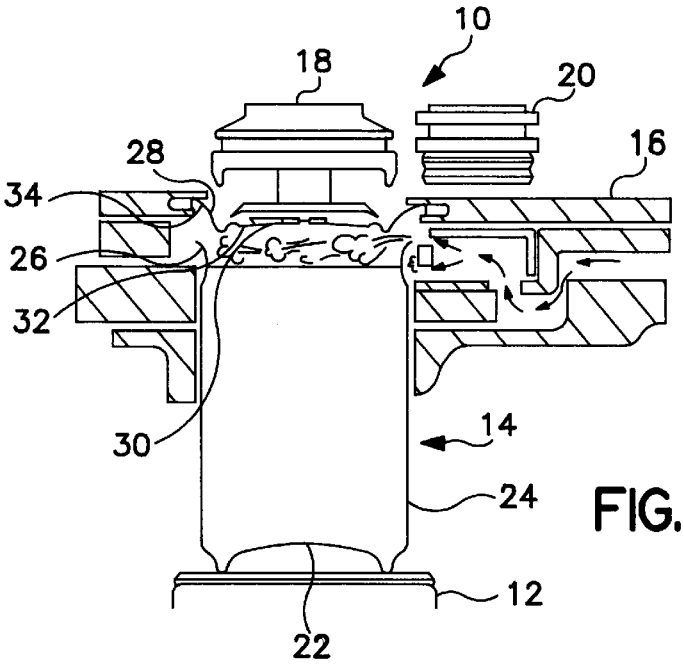
FIG. 1 is a partial cross-sectional side elevational view of can seam-forming apparatus.

Referring to FIG. 1, the apparatus 10 includes a rotating metal chuck 12 for holding a can 14, a lid support 16, a lid engaging chuck 18, and a seaming roll 20. In the embodiment illustrated, the can 14 is a deep-drawn metal can having a bottom wall 22, a sidewall 24, and a lip 26 extending outwardly from the sidewall 24. A lid 28 has a portion 30 substantially surrounded by an annular recess 32 and a radially-extending lip 34.

As shown in FIG. 1, the can 14 is filled with the desired contents, such as a beverage, and positioned on the chuck 12, and the lid 28 is placed in proximity to the lip 26 of the can 14. An inert gas is typically introduced into the air space above the contents in the can to purge air and any airborne contaminants from the can. The lid chuck 18 is then lowered to position the lid 28 directly onto the lip 26 of the can 14.

Figure 2:
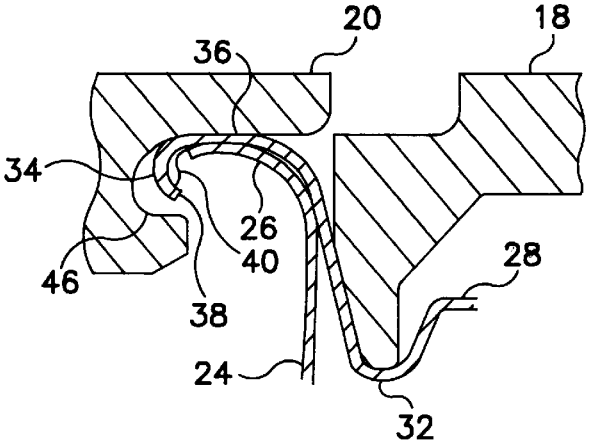
FIG. 2 is a partial cross-sectional side view of the can seam-forming apparatus before the start of the seam formation.

As shown in FIG. 2, the lip 26 of the can 14 has a slightly curved section which extends radially outward substantially perpendicular to the sidewall 24. The lip 34 of the lid 28 has a first portion 36 extending substantially radially outward and terminates in a downwardly turned curved or curled section 38. A sealing compound 40 is provided between the areas of contact of the lid 28 and the lip 26 of the can 14. The lid chuck 18 is shaped to complement the shape of the lid 28 and to apply a slight downward pressure to hold the lid 28 onto the can 14. The lid chuck 18 and the can chuck 12 rotate simultaneously about a common axis to rotate the can and lid simultaneously during the seam-forming step.

The seaming roll 20 rotates about an axis substantially parallel to the axis of rotation of the lid chuck 18. The seaming roll 20 is movable toward the lid chuck 18 to engage the lip 34 of the lid 28 and to form the seam. FIGS. 2 through 5 show the sequence of the seaming operation to curl the lips of the lid and can and form a double seam.

Figure 3:
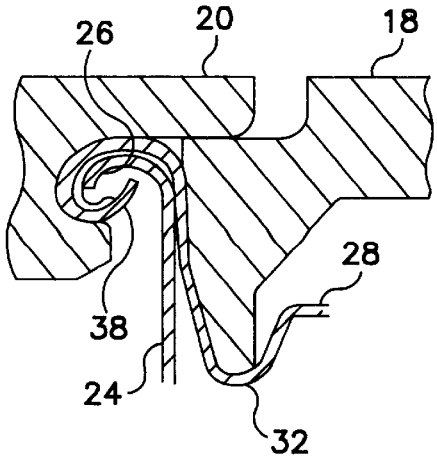
FIG. 3 is a partial cross-sectional side view showing a partially formed seam for forming the end curl of the seam.
Figure 4:
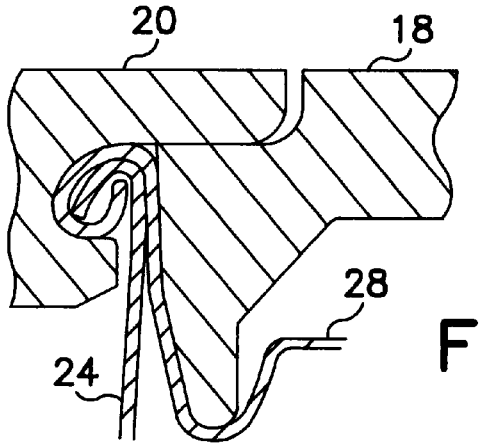
FIG. 4 is a partial cross-sectional side view of the end curl showing a substantially formed double seam.
Figure 5:
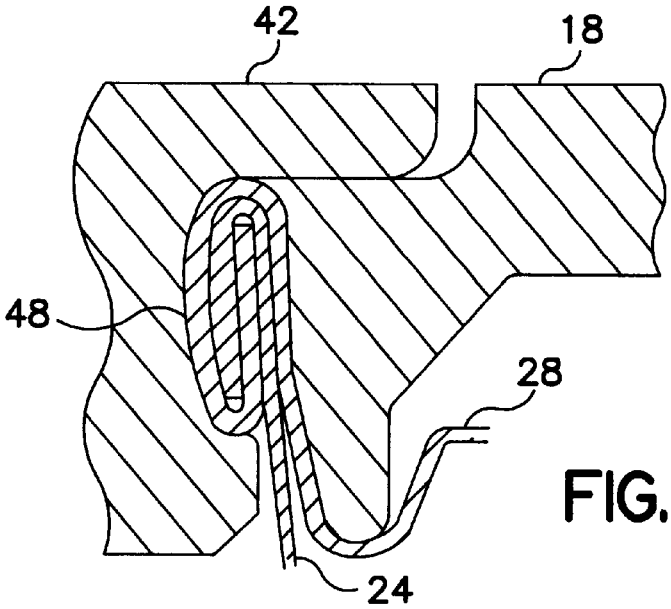
FIG. 5 is a partial cross-sectional side view of a finished double seam.

As shown in FIG. 2, seaming roll 20 includes an annular recess 46 dimensioned to receive the curved section 38 of lid 28. In operation, lid chuck 18 and can chuck 12 are rotated in opposite directions at the same speed. The seaming roll 20 is moved toward the lid chuck 18 while both are rotating to curl the edge of the lid inwardly and upwardly in a continuous operation as shown in FIG. 3. Further movement of the seaming roll 20 toward the lid chuck 18 further curls the lip 34 of the lid 28 to form the partially completed seam, as shown in FIG. 4. A second seam-forming roll 42 is pressed toward the lid chuck 18 to form the completed double seam 48, as shown in FIG. 5. The seam roll and lid chuck are moved away from the can, and the can is conveyed to a further packaging or testing operation as known in the art.

Figure 6:
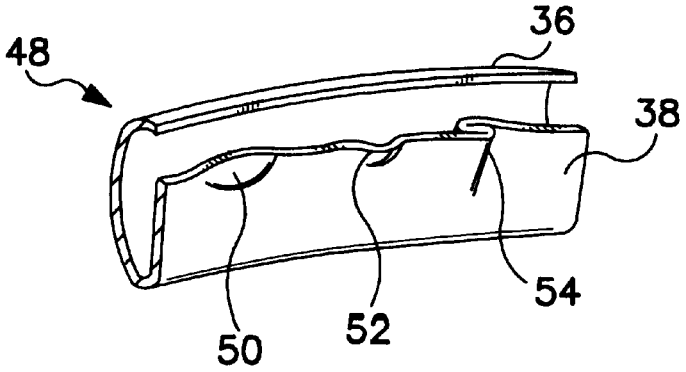
FIG. 6 is a partial cross-sectional perspective view of a seam of a lid showing defects in the seam formation.

FIG. 6 is a partial cross-sectional view of the lip 34 of the lid 28 after the curling and seam-forming step. FIG. 6 further shows three typical defects which occur in the curling and seam-forming operation which often result in leakage of the can. A loose wrinkle 50 refers to a wrinkled section of the end of the lip which is folded outwardly from the axial dimension of the can, so that it does not form a complete seal between the lid and the lip of the can. Another typical defect is a vee 52 formed in the lip and is defined by a wrinkled portion extending axially inward toward the center of the can. Another common defect is where portions of the lid are folded over on each other to form a pleat 54 in the seam. Each of these defects produces a bulge in the seal formed between the lid and the container. Such defects are typical causes of leaks in the finished can, which are often difficult to detect during the sealing and packaging operation. Many defective seams are not apparent until the product is shipped to the consumer. The method and apparatus of the present invention are able to detect such bulges in seams caused by these defects and identify defective containers whereby the defective containers can be removed from the manufacturing operation and discarded.

Figure 7:
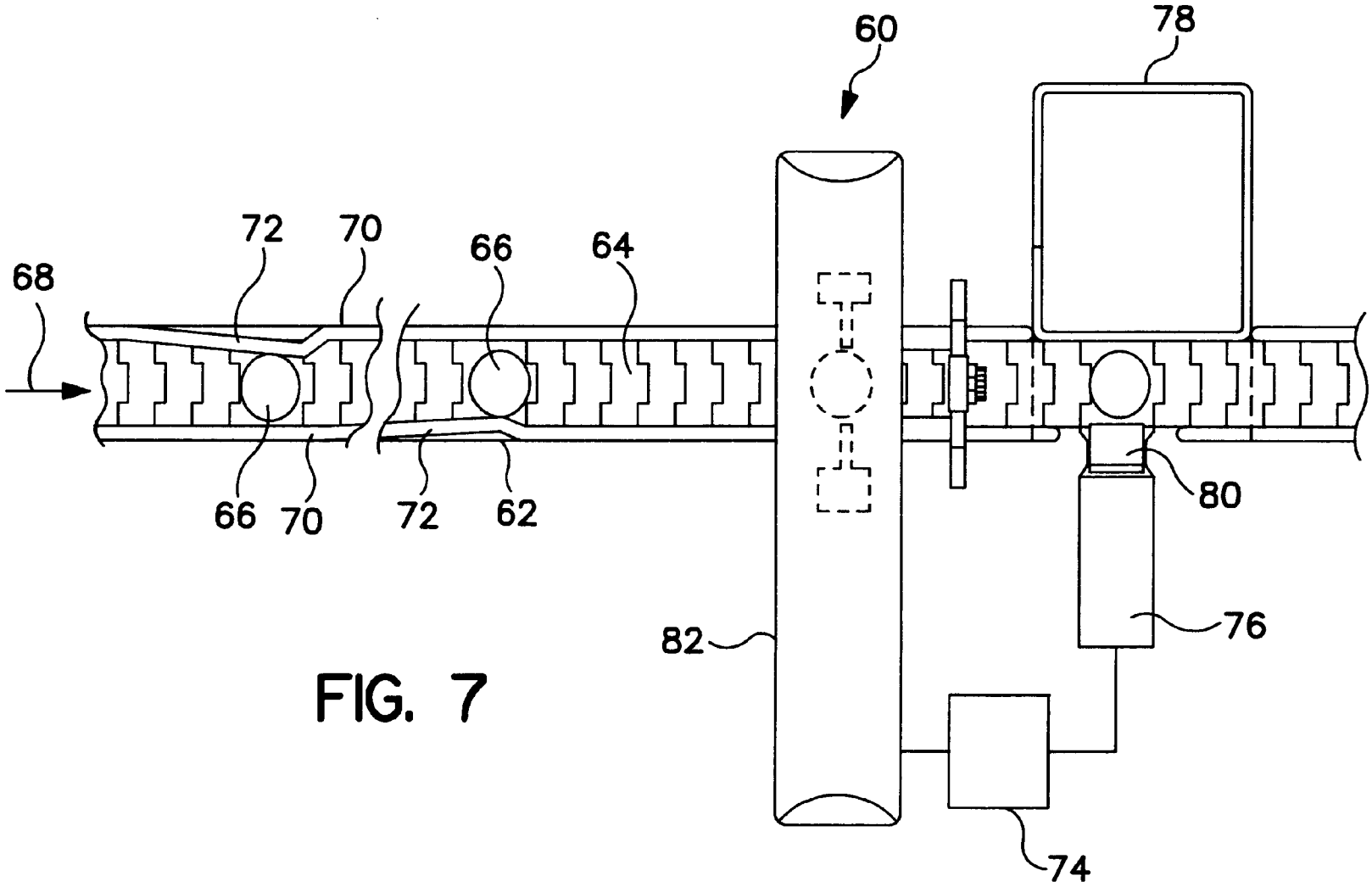
FIG. 7 is a top plan view of the conveyor and seam inspection apparatus in accordance with an embodiment of the invention.

Referring to FIG. 7, the detecting apparatus 60 is positioned in the operating section of a conveyor 62 downstream of a seam-forming apparatus such as that illustrated in FIGS. 1 through 5. Conveyor 62 can be any suitable conveying assembly as known in the art. In the embodiment illustrated in FIG. 7, conveyor 62 is a chain conveyor having a plurality of conveying sections 64 to define a surface for supporting the metal cans from the seam-forming apparatus to a downstream operation such as, for example, a packaging operation. As shown in FIG. 7, a plurality of cans 66 is conveyed in the direction of arrow 68 toward the detecting apparatus 60. In the embodiment illustrated, conveyor 62 includes a pair of side rails 70 for guiding the cans 66 along the conveyor path. Each side rail 70 includes an angled section 72 extending a slight distance toward the center of the conveyor 62 to divert and position the cans in a desired location on the conveyor as the cans are being conveyed.

The detecting apparatus 60 is connected to a microprocessor 74 which is, in turn, is connected to an ejection device 76. The cans are continuously conveyed through the detection apparatus 60 which detects defects in the seam and sends a suitable signal to the microprocessor 74. Microprocessor 74 includes a suitable timing sequence to actuate an ejector device 76 at the appropriate time to eject defective containers from the conveyor system into a hopper 78. Ejection device 76 can be any suitable device capable of pushing a defective container from the conveyor 62 without disturbing or interrupting the conveyance of properly sealed containers on the conveyor. In the embodiment illustrated, an ejector device 76 includes a pneumatic or solenoid-actuated plunger 80 which is able to extend transversely across the direction of travel of the conveyor 62 and push the defective containers from the conveyor and quickly retract to its original position.

Figure 8:
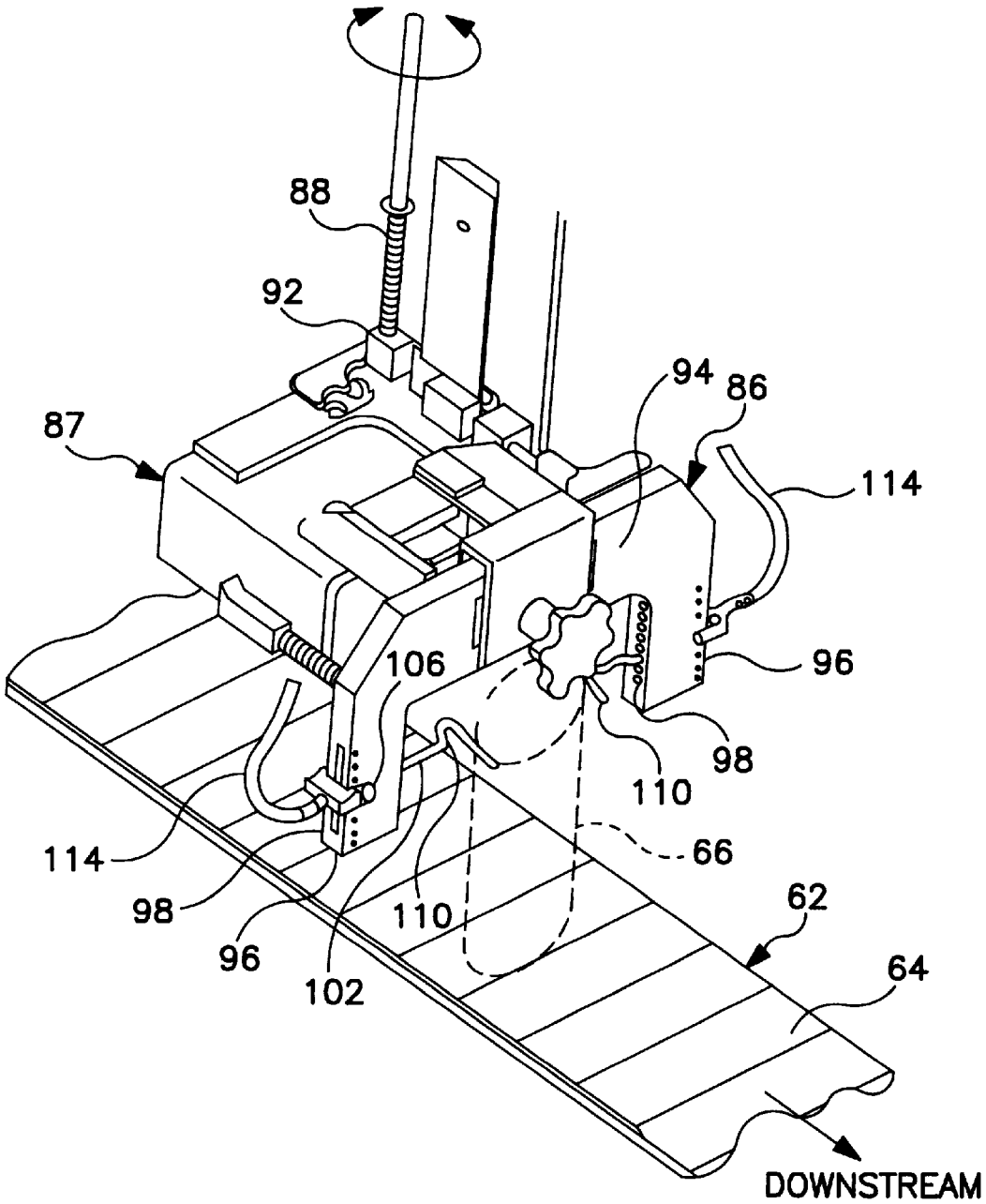
FIG. 8 is a perspective view of the seam inspection apparatus of the embodiment of FIG. 7.
Figure 9:
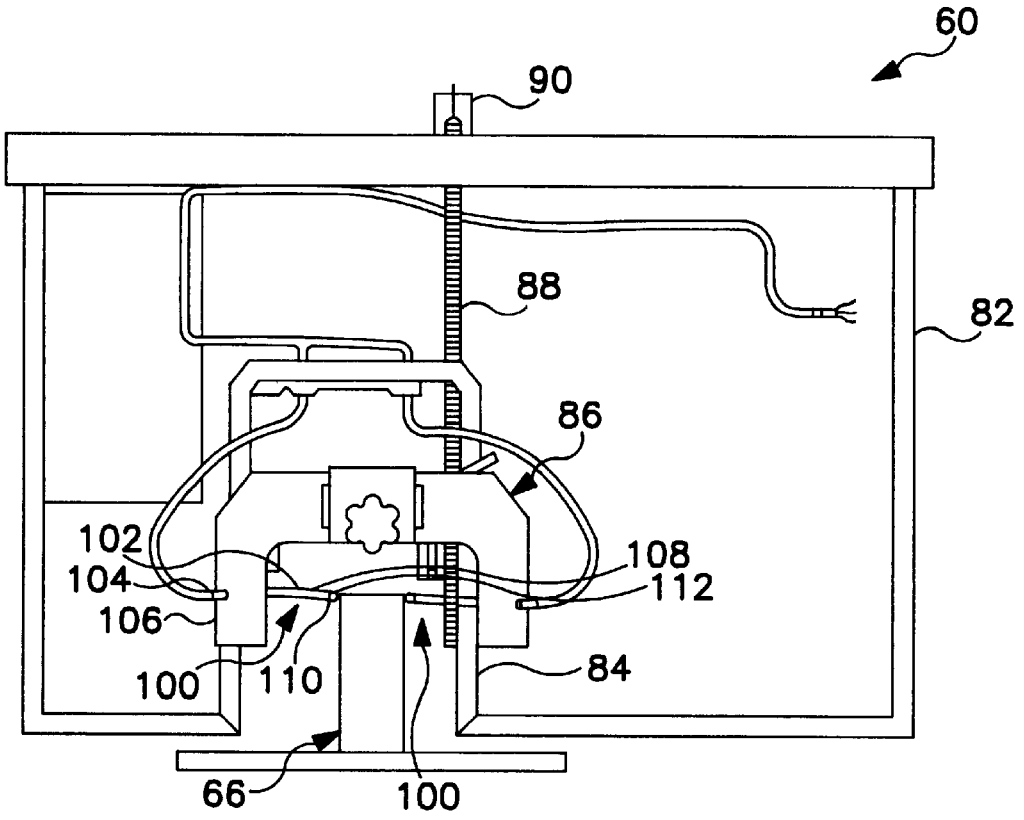
FIG. 9 is a discharge view of the seam inspection apparatus of the embodiment of FIG. 7.

Referring to FIGS. 8 and 9, the detecting apparatus 60 includes a housing 82, a support 84, and a yoke 86 mounted to a bracket 87. The bracket 87 is mounted to the support 84 by a threaded rod 88. The threaded rod 88 extends through the upper portion of the housing 82 and includes a handle 90 for rotating the threaded rod 88. The bracket 87 includes a threaded member 92 such that rotation of the threaded rod 88 raises and lowers the bracket 87 and the yoke 86 with respect to the conveyor 62.

Yoke 86 includes a horizontal portion 94 and a pair of legs 96 which extend downward toward the conveyor 62. The legs 96 are substantially parallel to each other and extend substantially perpendicular to the conveying surface of the conveyor 62. Each of the legs 96 includes a plurality of holes 98 extending transversely through the legs substantially perpendicular to the direction of travel of the conveyor 62. An electrical contact 100 is mounted in one of the holes 98 in each leg 96, as shown in FIG. 8. The electrical contacts 100 include a straight section 102 which extends through the respective hole 98 of the leg 96 of the yoke 86. A first end 104 of the straight section 102 is fixed to the leg 96 by screw 106. The second end 108 of the straight section 102 includes a horizontally upstream extended U-shaped portion 110 having a horizontally downstream extended leg 112. Each leg 112 of the electrical contact 100 extends substantially parallel to the conveyor surface. Each of the electrical contacts 100 is connected to wires 114 which are connected to the microprocessor 74.

The microprocessor 74 includes a suitable electrical power source for feeding an electrical current to the wires 114. In operation, a can having a bulge in the seam contacts each of the electrical contacts 100 to complete the circuit whereby the microprocessor produces a signal indicating a defective seam. The microprocessor 74, through a suitable timing sequence, sends a signal to ejector device 74 to actuate the ejector and remove the defective container from the conveyor.

In use, the yoke 86 is positioned above the conveyor 62 such that the cans 66 pass between the legs 96 and the electrical contacts 100. The electrical contacts 100 are adjusted to be spaced apart a distance whereby a properly seamed can will be able to pass between the electrical contacts without completing the electrical circuit. The clearance between the electrical contacts and a properly formed seam is sufficiently small such that a bulge formed in a defective seam enables the seam to contact both of the electrical contacts and complete the circuit, thereby producing a signal indicating a defective container. The position of each electrical contact 100 can be adjusted by loosening the screw 106 and sliding the electrical contact axially through the hole 98 in the legs 96. The spacing between the electrical contacts 100 and the conveyor surface 62 can be selectively adjusted by replacing the electrical contact in any one of the holes in the legs of the yoke. Minute adjustments to the position of the electrical contacts can be made by rotating the threaded rod to raise and lower the bracket and yoke assembly from the conveyor surface. In preferred embodiments, the position of the electrical contacts is adjusted to allow the contacts to touch the seam of the can without contacting or touching the sidewall of the can.

The apparatus of FIGS. 7 through 9 illustrates a preferred embodiment for performing the method of detecting defective seams in accordance with the present invention. As shown in FIG. 7, cans 66 are received from the seam-forming apparatus and conveyed along the conveyor surface toward the detecting apparatus 60. Angled sections 72 of the side rails 70 guide the cans 66 to the center of the conveyor 64 as the cans are being conveyed. The angled sections 72 are positioned to place the cans in the desired location on the conveyor 64 to cooperate with the detecting device 60. The cans 66 are conveyed through the detecting device 60 where defects in the seam are identified and defective containers discarded. The yoke 86 of the detecting device is positioned whereby the electrical contacts 100 are aligned with the seam of the can 66. The electrical contacts 100 are spaced apart a distance such that a can having a properly formed seam is able to pass between the contacts without touching both of the contacts simultaneously. If the can 66 is slightly out of an optimum position on the conveyor 64, the seam may contact or touch one of the electrical contacts 100. However, a properly formed seam will have a dimension sufficiently small to pass between the opposing electrical contacts without contacting or touching both contacts simultaneously and thereby completing the electrical circuit. The electrical contacts 100 are positioned to provide nominal clearance between a properly formed seam and the contacts such that a bulge in the seam will engage both of the electrical contacts simultaneously and complete the electrical circuit. The microprocessor 74 detects the completion of the electrical circuit between the electrical contacts and produces a signal indicating the presence of a defective can. The cans are continuously conveyed from the detecting device without interruption. The microprocessor produces a signal through a suitable timing sequence to actuate the ejector device. The ejector device then removes the defective can from the conveyor such that properly formed cans are readily conveyed without interference from the defective cans.

While a single embodiment has been chosen to illustrate the invention, it will understood by those of ordinary skill in the art that various modifications and variations can be made to the apparatus and method without departing from the spirit and scope of the invention as defined in the appended claims.

We claim:

1. An apparatus for detecting defects in a seam formed between a container having an open top end and a metal lid crimped to the open top end, said apparatus comprising:

a conveyor for conveying said containers, said conveyor having a receiving end for receiving a plurality of said containers, and a discharge end for discharging said containers;

at least one detecting device comprising a yoke having a substantially horizontal portion and a pair of spaced-apart, vertical legs extending substantially perpendicular to said conveyor positioned between said receiving end and discharge end of said conveyor and having first and second electrical contacts mounted in said vertical legs and disposed on opposite sides of said conveyor and being positioned to contact a defect in said seam as said container is conveyed past said detecting device without said electrodes contacting a properly seamed container;

an electrical power source connected to said first and second electrical contacts;

a signal device connected to said electrical contacts to signal the presence of and to identify containers having a defective seam; and an ejector device positioned downstream of said detecting device for ejecting containers having a defective seam from said conveyor;

wherein said signal device is connected to said ejector device to actuate said ejector device at a predetermined timed sequence to eject a container having a detected seam from said conveyor.

2. The apparatus of claim 1, wherein said ejector device is a reciprocating arm to push said container from said conveyor.

3. The apparatus of claim 2, wherein said arm is pneumatically operated.

4. The apparatus of claim 1, wherein said detecting device comprises a yoke having a substantially horizontal portion and a pair of spaced-apart, vertical legs extending substantially perpendicular to said conveyor.

5. The apparatus of claim 4, wherein said first and second electrical contacts are mounted in said vertical legs.

6. The apparatus of claim 1, wherein said electrical contacts are removably mounted in said vertical legs and adjustable in a substantially horizontal direction to selectively adjust the position of said electrical contacts with respect to said containers on said conveyor.

7. The apparatus of claim 1, wherein said yoke is mounted for selectively adjusting the height of said electrical contacts with respect to said conveyor.

8. The apparatus of claim 1, wherein said electrical contacts are independently adjustable toward each other.

9. A method for separating a container having a defective seam from a plurality of containers having open top ends and metal lids crimped thereto, whereby seams are formed at the juncture of said open top ends and said lids; said method comprising the steps of:

positioning a plurality of said containers on the receiving end of a conveyor having a receiving end for receiving a plurality of said containers, and a discharge end for discharging said containers;

conveying said containers through an apparatus for detecting said defective seam, said apparatus comprising:

at least one detecting device comprising a yoke having a substantially horizontal portion and a pair of spaced-apart, vertical legs extending substantially perpendicular to said conveyor positioned between said receiving end and discharge end of said conveyor and having first and second electrical contacts mounted in said vertical legs and disposed on opposite sides of said conveyor and being positioned to contact a defect in said seam as said container is conveyed past said detecting device without said electrodes contacting a properly seamed container;

an electrical power source connected to said first and second electrical contacts;

a signal device connected to said electrical contacts to signal the presence of and to identify containers having a defective seam; and an ejector device positioned downstream of said detecting device for ejecting containers having a defective seam from said conveyor;

wherein said signal device is connected to said ejector device to actuate said ejector device at a predetermined timed sequence to eject a container having a detected defective seam from said conveyor;

producing a signal responsive to said container having a defective seam contacting said electrical contacts; and ejecting said container having a defective seam from the conveyor.

10. The method of claim 9 wherein said ejector device comprises a reciprocating arm to push the container from the conveyor.

11. The method of claim 10 wherein said reciprocating arm is pneumatically operated.

12. The method of claim 9 wherein said electrical contacts are independently adjustable toward one another.

13. The method of claim 9 wherein said electrical contacts are adjustably mounted for selectively adjusting the height of said electrical contacts with respect to the conveyor.

* * * * *